United States Patent [19]

Coco

[11] Patent Number: 4,997,682

[45] Date of Patent: Mar. 5, 1991

[54] PAPER COATING COMPOSITION

[75] Inventor: Charles E. Coco, St. Louis, Mo.

[73] Assignee: Protein Technologies International, Inc., St. Louis, Mo.

[21] Appl. No.: 376,427

[22] Filed: Jul. 6, 1989

[51] Int. Cl.[5] ..... B05D 3/12

[52] U.S. Cl. ..... 427/362; 427/391; 428/511; 527/201; 527/202

[58] Field of Search ..... 427/361, 362, 391; 527/201, 202; 428/511

[56] References Cited

U.S. PATENT DOCUMENTS

| | | | |
|---|---|---|---|
| 2,246,466 | 6/1941 | Julian et al. | 260/112 |
| 2,274,983 | 3/1943 | Hieronymus | 260/112 |
| 2,397,307 | 3/1946 | Youtz | 260/112 |
| 2,712,539 | 7/1955 | Nugent et al. | 260/123.5 |
| 2,849,334 | 8/1958 | Hart | 117/64 |
| 2,881,076 | 4/1959 | Sair | 99/14 |
| 2,950,214 | 8/1960 | Smith | 117/64 |
| 3,081,182 | 3/1963 | Mahoney | 106/146 |
| 3,411,925 | 11/1968 | Lauterbach | 106/157 |
| 3,694,221 | 9/1972 | Hoer et al. | 99/17 |
| 4,048,380 | 9/1977 | Blakey et al. | 428/511 |
| 4,109,056 | 8/1978 | Craig et al. | 428/512 |
| 4,277,524 | 7/1981 | Nakajima et al. | 427/362 |
| 4,309,344 | 1/1982 | Walsh | 260/123.5 |
| 4,352,692 | 10/1982 | Krinski et al. | 106/79 |
| 4,421,564 | 12/1983 | Graham et al. | 106/154 R |
| 4,464,296 | 8/1984 | Jacks et al. | 260/123.5 |
| 4,474,694 | 10/1984 | Coco et al. | 260/123.5 |
| 4,520,048 | 5/1985 | Ranger | 427/350 |
| 4,575,477 | 3/1986 | Werkema et al. | 428/537.5 |
| 4,581,257 | 4/1986 | Kondo et al. | 427/336 |
| 4,607,089 | 8/1986 | Riley et al. | 527/201 |
| 4,620,992 | 11/1986 | Nojima et al. | 427/362 |
| 4,689,381 | 8/1987 | Krinski et al. | 527/201 |
| 4,812,550 | 3/1989 | Erickson et al. | 527/201 |
| 4,824,940 | 4/1989 | Shih | 530/377 |

OTHER PUBLICATIONS

"Soy Protein Latex Interpolymers—Properties and Function", Proceedings of the 1987 Coating Conference TAPPI, pp. 133–139, (Coco), C. E.

"Ultrahigh Finish Coated Papers—Cast Coating and Other Processes", Pigmented Coating Processes for Paper and Board, TAPPI Monograph No. 28, pp. 74–85, Casey, J. P.

"Isolated Soy Protein Binders for Paper and Paperboard Coatings", Protein Binders In Paper and Paperboard Coating, TAPPI Monograph No., pp. 75–96, Olson, R. A. and Hoelderle, P. T.

"Pigment Coating", Pulp and Paper Chemistry and Chemical Technology, pp. 1551–1753, 1961, Casey, J. P.

"Preparation and Functional Properties of Enzymatically Deamidated Soy Protein", Journal of Food Science, vol. 54, No. 3, 1989, pp. 598–602 (Hamada and Marshall).

"Deamidation of Food Proteins by Protease in Alkaline pH", Journal of Agricultural Chemistry, vol. 35, 1987, pp. 224–227, (Kato Tanaka, Matsudomi and Kobayashi).

*Primary Examiner*—Michael Lusignan

*Attorney, Agent, or Firm*—Virgil B. Hill

[57] ABSTRACT

An improved process of cast coating and the coating composition used therein produces a paper coating which has exceptional brightness, gloss, smoothness, flexibility, resistance to drum adhesions and pick resistance. The paper coating is especially effective in cast coating where extremely high smoothness and gloss is essential. The paper coating composition utilizes soy protein binder which has been modified by copolymerization to add a synthetic component to modify the properties of the soy protein.

7 Claims, No Drawings

PAPER COATING COMPOSITION

BACKGROUND AND SUMMARY OF THE INVENTION

This invention relates to production of protein containing paper coating compositions and particularly to production of paper coating compositions which find a special utility in cast coated papers where extremely high gloss, smoothness, flexibility, resistance to drum adhesion and pick resistance are required. Applicant is aware of the following U.S. Patents, the disclosures of which are incorporated by reference herein. Nos.

2,274,983
2,246,466
2,849,334
2,881,076
2,950,214
3,081,182
3,411,925
4,048,380
4,109,056
4,277,524
4,352,692
4,421,564
4,474,694
4,520,048
4,575,477
4,581,257
4,607,089
4,620,992
4,812,550

In addition, information relating to cast coating techniques may be found at:

"Soy Protein Latex Interpolymers—Properties and Function," *Proceeding of the* 1987 *Coating Conference TAPPI*, pp 133-139, Coco, C. E.;

"Ultrahigh Finish Coated Papers—Cast Coating and Other Processes," *Pigmented Coating Processes For Paper and Board, TAPPI Monograph No.* 28, pp 74-85, Casey, J. P.

"Isolated Soy Protein Binders for Paper and Paperboard Coatings," *Protein Binders In Paper and Paperboard Coating, TAPPI Monograph No.*, pp. 75-96, Olson, R. A. and Hoelderle, P. T.; and "Pigment Coating," *Pulp and Paper Chemistry and Chemical Technology*, pp 1551-1753, 1961, Casey, J. P.

These publications are also incorporated by reference herein.

Basic coating techniques for cast coated paper are well known and the use of protein adhesive binders for coating formulations for these papers is well known in the art. The use of vegetable protein adhesive binders, such as modified soy protein, is also known. However, the adhesive of choice for these products is typically a casein/latex combination, due to the greater whiteness, smoothness, gloss uniformity and pick release which can be obtained with casein/latex formulations.

The soy protein adhesive binders, where used in paper coating, are typically those prepared from isolated soy protein extracted from oil free soybean flakes in an alkaline solution and then recovered by isoelectric precipitation. Recovered soy protein is typically modified by hydrolysis and other chemical treatment to prepare a protein adhesive material suitable for use as a binder in paper coating compositions. Binders of this type find many uses in the paper coating industry. Recently however, a modified adhesive binder, such as disclosed in U.S. Pat. Nos. 4,607,089; 4,620,992 and 4,812,550 has also been used for some paper coating applications.

However, in spite of the general acceptance of soy protein based materials as adhesive binders, the soy protein binders have suffered some disadvantages, particularly when compared with casein/synthetic resin combinations, in preparing adhesive binders for cast coating. For the most part, paper coatings compositions used for cast coated fancy paper have not used soy binders. There, the state of the art binder is a combination of casein and a synthetic adhesive such as latex. These casein/synthetic formulations have provided the most optimum combination of smoothness, gloss and runability.

Applicant has found, however, that by use of particular combinations of coating components, applicant can produce a soy protein based coating composition which produces an extremely flexible, smooth and glossy coated paper. The coated paper has exceptional pick resistance and drum release, superior to the best casein/latex formulations. Applicant's invention requires the use of a soy/synthetic graft polymer as an adhesive binder and preferably includes control of the binder in combination with the other coating components.

It is thus an object of applicant's invention to prepare a coating composition and process suitable for coating of cast coated papers having an extremely high gloss, smoothness, flexibility, pick resistance and drum release.

It is an object of applicant's invention to prepare an adhesive binder from soy protein using a soy/synthetic copolymer which has the ability to produce coated papers which have extreme smoothness, flexibility, gloss, pick resistance and drum release.

It is an object of applicant's invention to produce an adhesive binder and process which can run on conventional cast coating processes and provide a high pick resistance in the coated paper.

It is a further object of applicant's invention to prepare a coating composition using a protein copolymer adhesive which combines with particular pigments to produce a smooth, high gloss, flexible and pick resistant paper.

These and other objects of the invention will be understood from the following description of the preferred embodiments.

DESCRIPTION OF THE PREFERRED EMBODIMENTS

The present invention utilizes soy protein copolymer adhesive binders in combination with particular coating pigments. Preferably, the invention utilizes a graft soy copolymer, prepared as described in U.S. Pat. Nos. 4,607,089 and 4,812,550. This adhesive binder, preferably used in combination with particular pigment combinations, has been found effective to achieve the objects of the present invention.

Cast coated paper having smoothness and gloss comparable to any such paper known in the art, and improved flexibility can be produced by use of applicant's invention. In particular, applicant's invention can produce paper having properties equal to or superior to paper produced using casein/latex adhesives. Moreover, even casein/latex based coating compositions suffer from drum adhesion and from pick. Pick is the loss of the adhesion of the coating composition to the paper substrate during printing.

Drum adhesion occurs on the casting drum. In drum adhesion, the coating loses adhesion to the paper substrate, in local areas, and adheres to the casting drum as small particles. As the casting drum revolves, these particles accumulate additional coating material and leave voids in the paper surface. The voids result in a coated paper which is rough, porous and has low gloss. Drum adhesion is particularly associated with high latex content in the coating formulation. The latex component is essential in conventional formulations, since the latex is needed to impart flexibility to the coated paper produced by the casting process. However, with conventional formulations it has not been practical to use coating formulations in which the latex component is above 60% of the total binder, if that much. At this high level of latex, too much latex contacts the hot surface of the casting drum. Since the latex is thermoplastic in nature, it melts and adheres to the casting drum resulting in drum adhesion, as described above. This feature, drum adhesion, of conventional coating formulations, severely limits the amount of latex which can be used in the coating formulation and limits the flexibility, smoothness and gloss which can be imparted by latex addition.

Applicant has found that by using a soy/synthetic copolymer the latex component of the binder, as part of the copolymer, can be increased to as much as 80% of the binder. As a result, the coating composition formed from the binder has extraordinary resistance to drum adhesion and has exceptional gloss, flexibility, smoothness and pick resistance.

Pick resistance is believed to result from the segregation or separation of the adhesive and other components in the coating formulation during the coating and drying process itself. To counteract this effect, various dispersants and additives are typically added to coating formulations to keep the coating components uniformly dispersed in the coating composition during coating and drying of the paper web. These techniques have been effective to make casein/latex combination binders the best known in the art to date.

Applicant has found that by using a soy copolymer, of the type described in the patents noted above, preferably in combination with particular pigments, coating formulations can be produced which overcome the limitations of casein/latex based coating formulations. Applicant is able to produce cast coated paper having high gloss, high flexibility, high color (whiteness), high smoothness and can substantially eliminate coating pick, as determined by standard tests.

Applicant has found that the use of a protein/synthetic copolymer unexpectedly increases the synthetic (latex) component which can be incorporated in the binder (and coating composition formulation). In the copolymer binder it is believed that the synthetic or latex moiety is surrounded or protected by the protein shell. As a result, the synthetic moiety is held out of contact with the casting drum. To a substantial degree only the protein moiety contacts the casting drum. Consequently the synthetic moiety does not overheat, melt or adhere to the surface of the casting drum. The copolymer may contain as much as 80% synthetic moieties; the 20% soy moiety is still sufficient to protect the synthetic elements from the casting drum surface. However, the 80% synthetic provides flexibility enhancement, smoothness and gloss equivalent to 80% free latex, and providing resistance to pick.

Applicant's coating composition preferably uses clay and calcium carbonate pigments in combination with the soy copolymer binder, though other conventional pigments may be used. Applicant's coating process produces a flexible, high gloss, smooth coated paper having superior aesthetic and optical qualities required for fancy papers of the type described. In particular, applicant's coating composition produces a coated paper having substantially no drum adhesion and no pick. The clay and calcium carbonate, which have been found effective to combine with copolymer binders, may each be present at levels between about 10% to 90% by weight of the total pigment present in the coating composition of the invention. The copolymer binder may be present at between about 10% to 25% by weight of the pigment.

The invention may be further understood by reference to the following examples.

EXAMPLE 1

A cast coating composition was prepared from the following formulation:

90 parts by weight clay
10 parts by weight calcium carbonate
0.2 parts by weight dispersant
0.1 parts by weight defoamer
U.S. Pat. No. 4,607,089 (RP 535)[82% synthetic moiety]
0.5 parts by weight release agent The above coating composition was suspended in room temperature water (58% solids), the pH was adjusted to 9.4 and the aqueous composition was coated utilizing a cast coating process. The coat weight was 20 pounds per ream. The web speed was about 250 feet per minute. After coating, the coated paper from the process was subjected to tests of its gloss, color, smoothness and pick resistance. The results of those tests are given in Table 1. The coated paper was examined and judged to have high flexibility.

EXAMPLE 2

For comparison, a casein/latex cast coating composition was prepared from the following formulation:

90 parts by weight clay
10 parts by weight calcium carbonate
0.2 parts by weight dispersant
0.1 parts by weight defoamer
10 parts by weight casein
6 parts by weight latex
0.5 parts by weight release agent The above coating composition was suspended in room temperature water (58% solids) the pH was adjusted to 9.4 and the aqueous composition was coated utilizing a cast coating process. The coat weight was 20 pounds per ream. The web speed was approximately 250 feet per minute. After coating, the coated paper from the process was then subjected to tests of its gloss, color, smoothness and pick resistance. The results of those tests are given in Table 1. The coated paper was examined and judged to have high flexibility.

EXAMPLE 3

A cast coating composition was prepared from the following formulation:

10 parts by weight clay
90 parts by weight calcium carbonate
0.2 parts by weight dispersant
0.1 parts by weight defoamer 15 parts by weight soy synthetic interpolymer, U.S. Pat. No. 4,607,089 (RP 535)[82% synthetic moiety]
0.5 parts by weight release agent The above coating composition was suspended in room temperature water (58% solids), the pH was adjusted to 9.4 and the aqueous composition was coated utilizing a cast coating process. The coat weight was 20 pounds per ream. The web speed was about 250 feet per minute. After coating, the coated paper from the process was then subjected to tests of its gloss, color, smoothness and pick resistance. The results of those tests are given in Table 1. The coated paper was examined and judged to have high flexibility.

EXAMPLE 4

For comparison, a casein/latex cast coating composition was prepared from the following formulation:

10 parts by weight clay
90 parts by weight calcium carbonate
0.2 parts by weight dispersant
0.1 parts by weight defoamer
10 parts by weight casein
0.5 parts by weight release agent
6 parts by weight latex The above coating composition was suspended in room temperature water (58% solids), the pH was adjusted to 9.4 and the aqueous composition was coated utilizing a cast coating process. The coat weight was 20 pounds per ream. The web speed was about 250 feet per minute. After coating, the coated paper from the process was then subjected to tests of its gloss, color, smoothness and pick resistance. The results of those tests are given in Table 1. The coated paper was examined and judged to have high flexibility.

TABLE 1

| | Example 1 | Example 2 | Example 3 | Example 4 |
|---|---|---|---|---|
| 20° Gloss | 60 | 45 | 43 | 36 |
| 75° Gloss | 92 | 85 | 85 | 83 |
| Hunter Color L (Whitness) | 91.5 | 91 | 95 | 95 |
| Hunter Color a (red/green) | 0.6 | 0.6 | 0.15 | 0.15 |
| Hunter Color b (blue/yellow) | 3.7 | 3.7 | 2.8 | 3.0 |
| Parker Smoothness (S-5) | 0.80 | 0.93 | 0.80 | 0.93 |
| Parker Smoothness (S-10) | 0.67 | 0.73 | 0.67 | 0.73 |
| K & N (% loss) | 31 | 37 | 10 | 16 |

TABLE 1-continued

| | Example 1 | Example 2 | Example 3 | Example 4 |
|---|---|---|---|---|
| Ink Gloss | 95 | 94 | 88 | 86 |
| IGT pick (cm/sec) | none | 175 | none | 135 |

It will be appreciated by those skilled in the art that various changes may be made in the invention as disclosed without departing from the spirit of the invention. The invention is not to be limited to the specifics of the disclosed embodiments, which are for purposes of illustration, but rather is to be limited only by the scope of the appended claims and their equivalents.

I claim:

1. A method of producing a cast coated paper having high gloss, flexibility, smoothness, brightness, resistance to drum adhesion and pick resistance comprising preparing an aqueous paper coating composition containing paper coating pigments and an adhesive binder, the adhesive binder consisting essentially of a soy protein synthetic graft copolymer, having a synthetic moiety of between about 60–80% of the copolymer, the synthetic moiety being substantially surrounded by the protein moiety of the copolymer, the combination of pigment and adhesive binder being effective to product a high gloss, flexible, smooth, bright and substantially pick free cast coated paper when coated on a paper web substrate and being effective to substantially reduce drum adhesion, the protein moiety of the polymer protecting the synthetic moiety of the copolymer and substantially reducing the contact of the synthetic moiety with a casting drum during curing, coating a paper web substrate with the aqueous paper coating composition placing the coated paper web in contact with a casting drum and curing the coated paper web substrate to form a finished cast paper.

2. The process of claim 1 wherein the copolymer is a graft copolymer of a conjugated diene and a vinyl aryl monomer polymerized on a soy protein shell.

3. The process of claim 1 wherein the synthetic moiety of the copolymer is about 80% by weight of the copolymer.

4. The process of claim 1 wherein the copolymer is a butadiene-styrene copolymer.

5. The process of claim 4 wherein the finished paper is a cast coated paper.

6. The process of claim 4 wherein the butadiene-styrene moiety is about 80% by weight of the copolymer.

7. A coated paper product produced by the method of claim 1.

* * * * *